US007527518B1

(12) United States Patent
Libby

(10) Patent No.: US 7,527,518 B1
(45) Date of Patent: May 5, 2009

(54) CONTACT DEVICE FOR INSULATION DISPLACEMENT CONNECTOR

(75) Inventor: Robert A. Libby, Williamsport, PA (US)

(73) Assignee: Aslan Industries Corporation, Montoursville, PA (US)

( * ) Notice: Subject to any disclaimer, the term of this patent is extended or adjusted under 35 U.S.C. 154(b) by 0 days.

(21) Appl. No.: 12/150,085

(22) Filed: Apr. 23, 2008

(51) Int. Cl.
*H01R 4/24* (2006.01)

(52) U.S. Cl. ..... 439/404; 439/395; 439/857; 439/858

(58) Field of Classification Search ..... 439/404, 439/857, 858, 395
See application file for complete search history.

(56) References Cited

U.S. PATENT DOCUMENTS 4,405,193 A * 9/1983 Weidler ..... 439/398
4,527,857 A * 7/1985 Hughes et al. ..... 439/849
5,785,551 A 7/1998 Libby
5,915,990 A * 6/1999 Beer et al. ..... 439/417
5,975,938 A 11/1999 Libby
6,045,417 A * 4/2000 Igel ..... 439/877
6,074,238 A 6/2000 DeRoss et al.
6,325,659 B1 * 12/2001 Heinzen et al. ..... 439/404
7,144,269 B2 12/2006 Libby et al.

* cited by examiner

*Primary Examiner*—Tho D Ta
(74) *Attorney, Agent, or Firm*—Thomas R. Shaffer

(57) ABSTRACT

A contact device for insulated solid conductors of an insulation displacement connector of the type utilized to make electrical connections with an unstripped end of a multi-conductor cable having an outer sheath enclosing a ground wire and at least two insulated solid wire conductors is disclosed. A first blade portion has a front contact portion, a first blade middle portion and a first blade rear receiving end. A second blade portion has a front angled blade portion, a second blade middle portion and a second blade rear receiving end. A bridge portion connects the first blade to the second blade and secures the second blade portion in a spaced apart relationship with respect to the first blade portion. With this arrangement when the contact device is pushed into a multi-conductor cable, the first contact portion is in electrical contact with a first side of a solid wire conductor and the front angled portion is in electrical contact with a second side of the solid wire conductor. Thus, the solid wire conductor is disposed between the first contact portion and the front angled portion to form and maintain a more reliable electrical connection even when expansion or contraction or some movement of the solid wire conductor or components of the contact device might occur.

17 Claims, 8 Drawing Sheets

CONTACT DEVICE FOR INSULATION DISPLACEMENT CONNECTOR

FIELD OF THE INVENTION

The present invention relates to a metallic contact device for insulated cable. More specifically, it relates to a manufactured metallic contact device having spaced apart arms to make reliable electrical connections with an unstripped end of a multi-conductor cable having an outer sheath enclosing a ground wire and at least two insulated solid wire conductors.

DESCRIPTION OF THE PRIOR ART

The purpose of an insulation displacement connector (IDC) is to make an electrical connection between the metallic conductors of an insulated cable and the metallic contacts in a connector. This is done to transfer electric current from the current carrying cable to a connector which then delivers current to any device or another cable. IDC's eliminate the need to manually strip insulation from electrical conductors and further eliminates the use of wire nuts to terminate these conductors.

Prior to the present invention, various connection devices have been proposed. For example, one such device was made by compressing a "Y" shape device into and through the insulation of a wire conductor to contact the metal wire as is disclosed in FIGS. 5-7 of DeRoss et al, U.S. Pat. No. 6,074,238. The DeRoss '238 patent teaches that it is necessary to manually remove the outer jacket of NM-B cable and place the individual wire conductors in the connector seen in FIGS. 17 and 18 of the patent.

In Libby, U.S. Pat. No. 5,975,938 (see FIGS. 2, 3, & 4), the insulation displacement is completed by piercing the wire with a rotating metal wheel. Another known device shows the insulation being pierced and cut with a single pointed and sharpened blade as illustrated in FIG. 13c of Libby, U.S. Pat. No. 5,785,551, and in FIGS. 6-10 of Libby et al., U.S. Pat. No. 7,144,269. All of the Libby patents suggest that the NM-B cable is inserted into the connector without removing the outer jacket. As stated in the Libby patents, NM-B or Romex® cable is a multi conductor cable which has a bare ground wire and at least two insulated solid conductors, one called a hot wire, and one called the neutral. These wires are then encased by an outer jacket or sheathed insulator. NM-B cable is primarily used in the wiring of residential homes to provide electricity throughout.

While various devices teach the piercing of an unstripped end of an electric cable to make electrical connections with insulated solid wire conductors, in practice, it is extremely difficult to provide such a system which reliably makes secure and adequate connections with not only the ground wire but also with the hot and neutral wires. The present invention is directed to the need of providing such a reliable connection to a hot wire or a neutral wire which maintains such a connection even when expansion or contraction or some movement of the solid wire conductor or components of the contact device might occur.

SUMMARY OF THE INVENTION

The present invention in its simplest form provides a contact device for insulated solid conductors of an insulation displacement connector of the type utilized to make electrical connections with an unstripped end of a multi-conductor cable having an outer sheath enclosing a ground wire and at least two insulated solid wire conductors comprising:

(a) a first blade portion having a front contact portion, a first blade middle portion and a first blade rear receiving end;

(b) a second blade portion having a front angled blade portion, a second blade middle portion and a second blade rear receiving end; and (c) a bridge portion connecting said first blade to said second blade and securing said second blade portion in a spaced apart relationship with said first blade portion whereby, when said contact device is pushed into a multi-conductor cable, said first contact portion is in electrical contact with a first side of a solid wire conductor and said front angled portion is in electrical contact with a second side of said solid wire conductor. With this arrangement said solid wire conductor is disposed between said first contact portion and said front angled portion to form a reliable electrical connection.

Preferably, when said contact device is pushed into a multi-conductor cable, insulation is displaced on a first side of a solid wire conductor by said first contact portion and insulation is displaced on a second side of a solid wire conductor by said front angled blade portion.

Preferably, said first contact portion includes a generally flat contact area which is orientated generally parallel with said solid wire conductor whereby electrical contact is made along a length of said first side of a solid wire conductor thereby creating a large contact area.

Preferably, said front angled blade portion is formed at an angle "A" relative to said front contact portion whereby said front angled portion is not oriented parallel to said first side of a solid wire conductor and said front angled portion makes electrical contact with said solid wire conductor at a single point along a length of said conductor. Angle "A" is preferably between 50 degrees and 65 degrees. Preferably, said front angled blade portion has an angled cutting edge and a cutting point which cut into the second side of said solid wire conductor. Preferably, said angled cutting edge has an angle "B" which is between 45 degrees and 65 degrees.

Preferably, said first blade has a first blade tail portion and said second blade has a second blade tail portion with said first blade tail portion and said second blade tail portion oriented relative to each other at an angle "D" of approximate 30 degrees.

Preferably, said first blade receiving end and said second blade receiving end contact one another and diverge outwardly from each other at an angle "C" which is between 75 degrees and 90 degrees.

Preferably, said bridge portion connects said first blade middle portion to said second blade middle portion. Preferably, said bridge portion connects said first blade middle portion to said second blade middle portion at an angle "E" which is between 0 degrees and 20 degrees.

Preferably, said contact device also includes an insulating fin member juxtaposed tightly against an opposite surface of said front contact portion said insulating fin adapted to remove at least a portion of insulation from said solid wire conductor. Preferably, said first blade portion and said second blade portion will help remove any insulation on the solid wire conductor not removed by the insulating fin.

Preferably, said contact device includes a pair of contact devices mounted in an insulation displacement connector with a first contact device of said pair adapted to make an electrical connection with one solid wire conductor to connect to a hot wire and a second contact device of said pair, said second contact device having a mirror image of said first contact device, adapted to make an electrical connection with a second solid wire conductor to connect to a neutral wire.

Preferably, said first blade portion, said second blade portion and said bridge portion are formed of a copper alloy.

Preferably, said front contact portion and said angled blade portion maintain a gas tight connection to said solid wire conductor even during variable conditions such as any one or more if the following: expansion of the solid wire conductor, contraction of the solid wire conductor, movement of the solid wire conductor, expansion of the contact device, contraction of the contact device, and movement of the contact device.

DETAILED DESCRIPTION OF THE PREFERRED EMBODIMENTS

Figure 1:
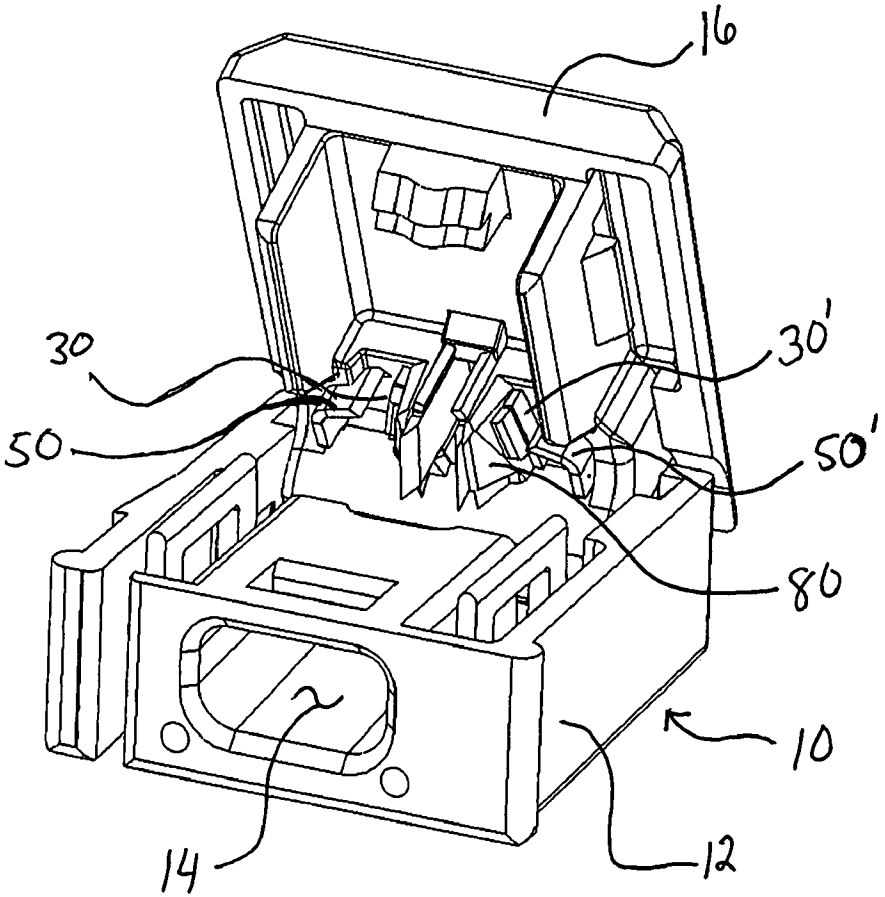
FIG. 1 is a perspective view of an insulated displacement connector of the present invention with a lid in an open position.
Figure 2:
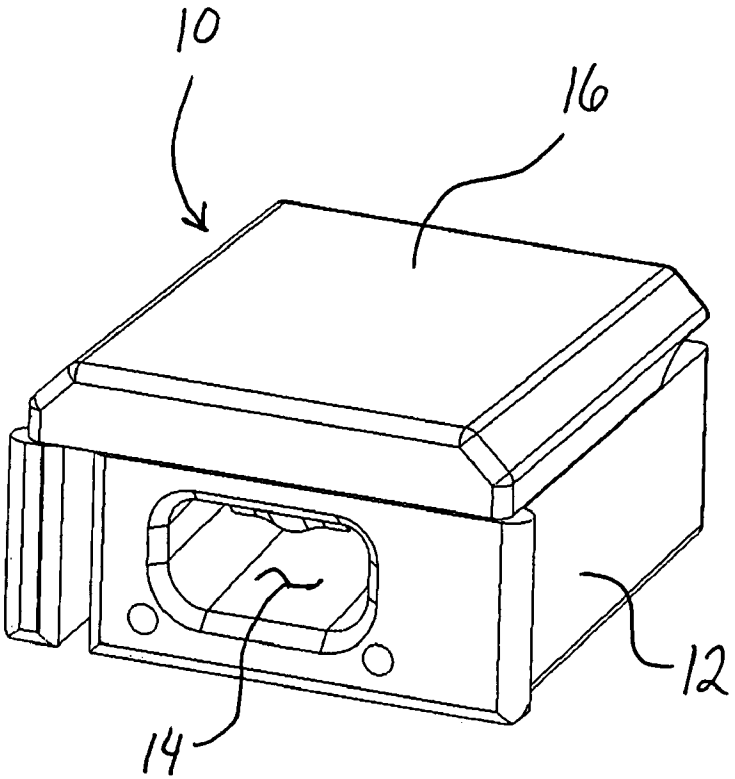
FIG. 2 is a perspective view of the insulated displacement connector of FIG. 1 with the lid in a closed position.
Figure 11:
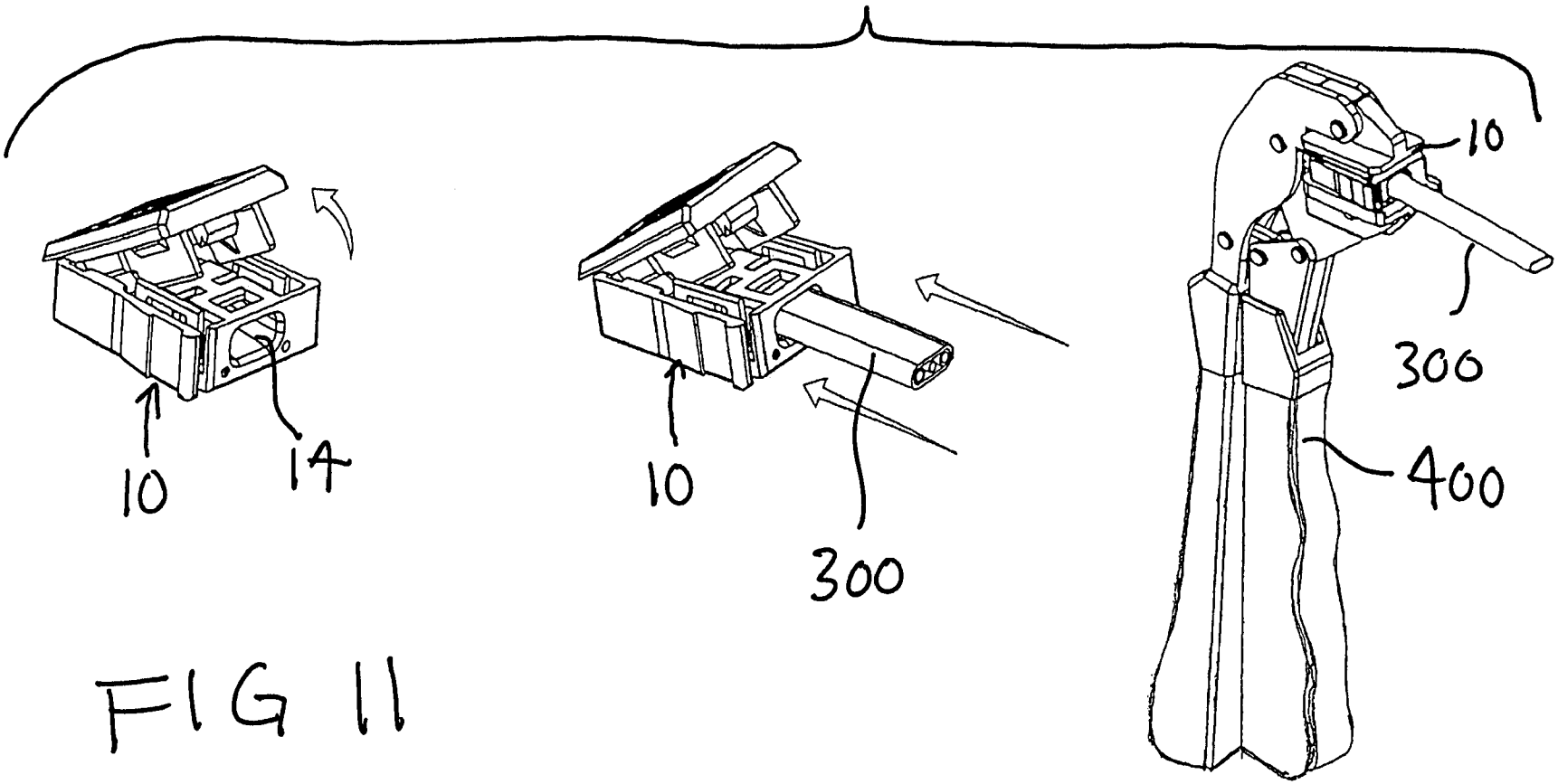
FIG. 11 is a sequence view of the process of connecting an insulated displacement connector to an unstripped end of cable 300.

Referring first to FIGS. 1, 2 and 11, the present invention provides an insulated displacement connector for quickly and easily connecting an unstripped end of an electrical cable 300 to the displacement connector. FIG. 1 shows the insulated displacement connector 10 which has a base portion 12 into which an opening 14 is provided so as to allow the insertion of a cable 300. FIG. 1 shows the connector 10 having a lid 16 in an open position. On the lower surface of the lid 16, a pair of first blade portions 30 and 30' and a pair of the second blade portions 50 and 50' are shown.

FIG. 2 shows the displacement connector 10 with the lid 16 in a closed position. FIG. 11 shows the sequence by which a cable 300 is inserted in to opening 14 with the lid in an open position and the closing of the lid 16 to a closed position by means of plier device 400.

Figure 3B:
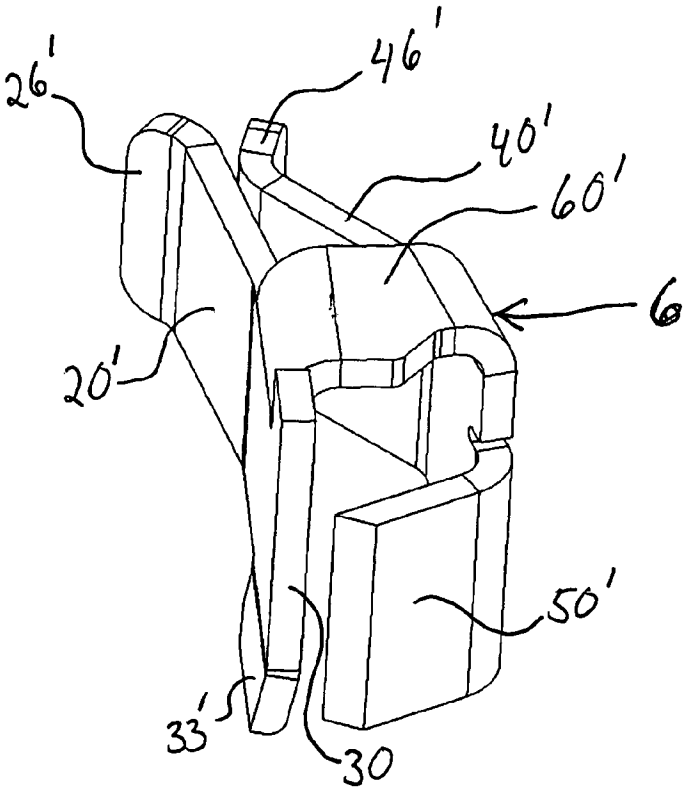
FIG. 3*b* is a perspective view of the contact device which has a mirror image to that shown in FIG. 3*a*.
Figure 3A:
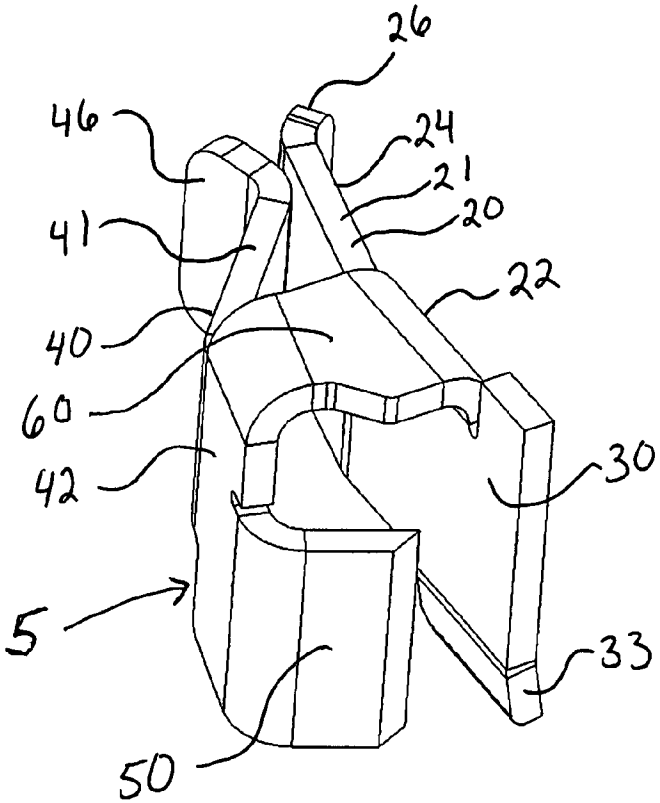
FIG. 3*a* is a perspective view of the contact device of the present invention.

Referring now to FIG. 3*a* and FIG. 3*b*, various details of the contact device are shown. Initially, contact device 5 (as shown in FIG. 3*a*) will be explained in detail. The contact device 6 shown in FIG. 3*b* is the mirror image of contact device 5 and all components have been labeled with the same numbering system with a prime designation provided on contact device 6. The contact device 5 includes a first blade portion 20, a second blade portion 40 and a bridge portion 60. The first blade portion 20 has a first blade front contact surface 30, a first blade middle portion 22, a first blade tail portion 24 and a first blade rear receiving end 26. The second blade portion 40 has a second blade front angled blade portion 50, a second blade middle portion 42, a second blade tail portion 44 and a second blade rear receiving end 46. A bridge portion 60 connects the first blade middle portion 22 with the second blade portion 42 in a manner that secures the first blade portion 20 in a spaced apart and generally parallel orientation with respect to the second blade portion 40. The first blade portion 20 and the second blade portion 40 are referred to as being spaced apart even though they do contact one another where rear receiving end 26 contacts second blade receiving end 46. To be more accurate, the bridge portion 60 is designed to hold the first blade front contact surface 30 with contact blade 33 in a spaced apart relationship with respect to the second blade front angled portion 50. The bridge portion 40 interconnects a top edge 21 of first blade member 22 and a top edge 41 of second blade member 40.

Figure 4:
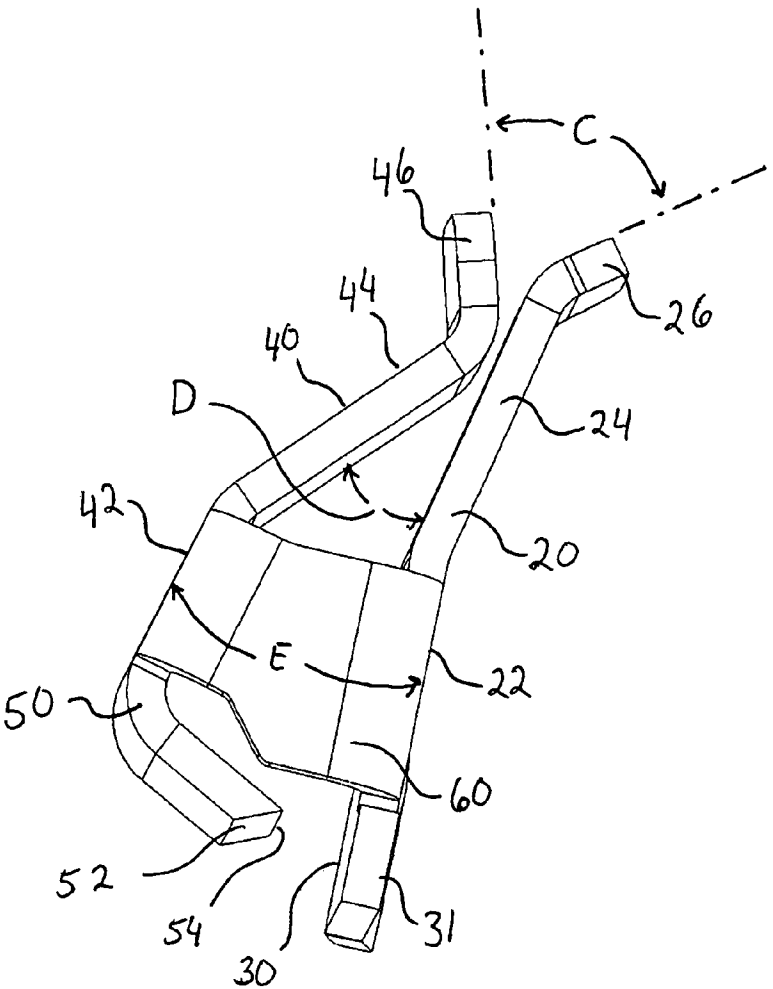
FIG. 4 is a top perspective view of the contact device of FIG. 3*a*.

Referring to FIG. 4, the relationship between the first blade portion 20 in second blade portion 40 will be more fully explained. The first blade rear receiving end 26 and the second blade rear receiving end 46 diverge outwardly from one another at an angle "C" which is between 75° and 90° and is preferably approximately 68.8°. The tail portion 24 of first blade 20 and the tail portion 44 of second blade 40 are preferably oriented relative to each other at an angle "D" which is approximately 30°. The first blade middle portion 22 is preferably oriented to the second blade middle portion 42 at an angle "E" which is between 0° and 20° and is preferably 15°. As shown, the second blade front angled portion 50 includes a cutting edge 52 and a cutting point 54.

Figure 5:
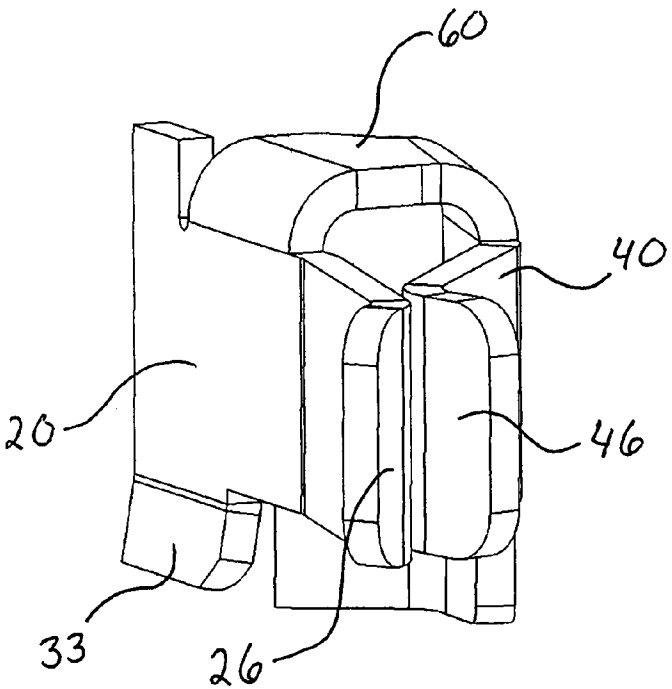
FIG. 5 is an end perspective view of the contact device of FIG. 3*a*.

FIG. 5 shows the rear receiving end 26 and the rear receiving end 46 which are adapted to receive a blade like connector from another device. It will be obvious to those skilled in the art that the rear receiving end can be formed to any desired shape needed to receive a connector of matching shape from some other device.

Figure 7:
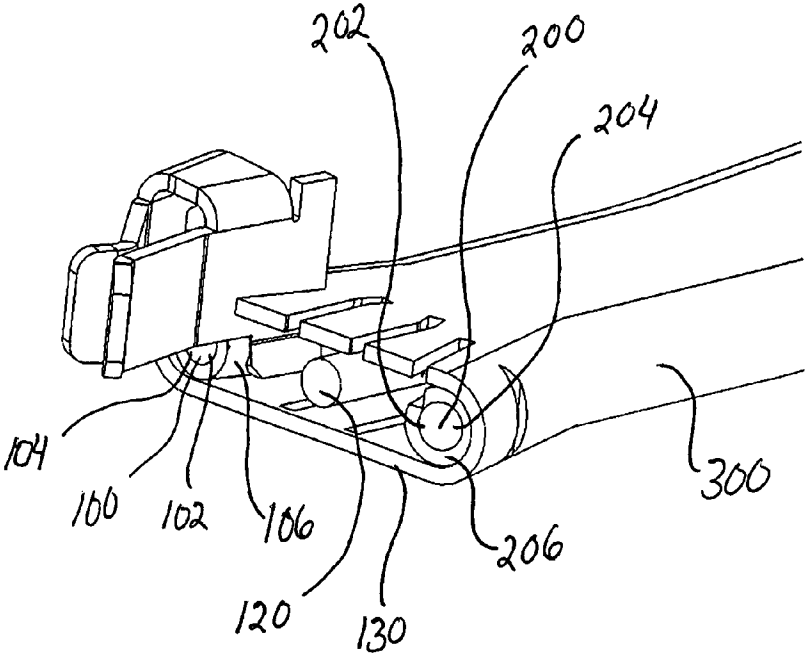
FIG. 7 is a perspective view of an unstripped end of cable 300.
Figure 6:
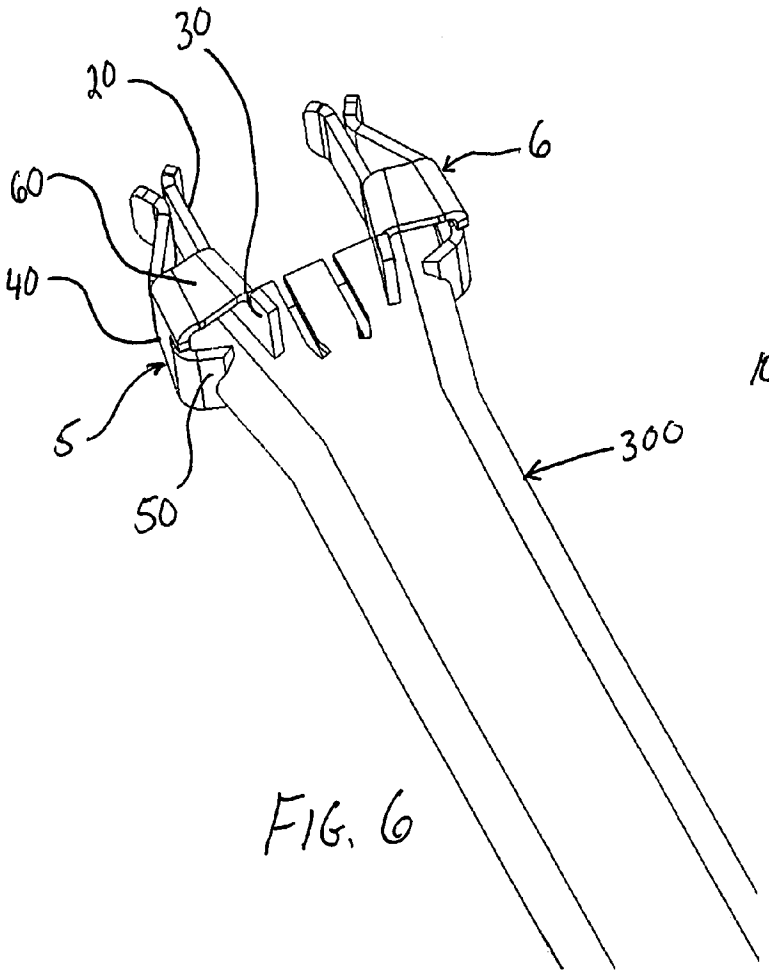
FIG. 6 is a top perspective view of the contact devices of FIGS. 3*a* and 3*b* as fully engaged on cable 300.

Referring to FIG. 6, contact device 5 and contact device 6 are shown in a fully engaged position on cable 300 with contact device 5 engaging solid wire conductor 100, which in this case is a neutral wire, and contact device 6 engaging solid wire conductor 200, which in this case is a hot wire. Referring to FIG. 7, it can be seen that the first blade front contact surface 30 is adapted to be in contact with a first side 102 of solid wire conductor 100 and that the second blade front angled blade portion 50 is adapted to cut into a second opposite side 104 of solid wire conductor 100. With this arrangement, the solid wire conductor 100 is secured firmly between the contact surface 30 in the angled blade portion 20. The contact surface 30, because it extends along a length of the solid wire conductor 100, provides a large contact area making a solid electrical connection. As shown in FIGS. 4 and 6, the cutting point 54 and cutting edge 52 of the angled blade portion 50 actually cut into side 104 of the conductor 100 to further ensure a solid electrical connection.

Figure 8:
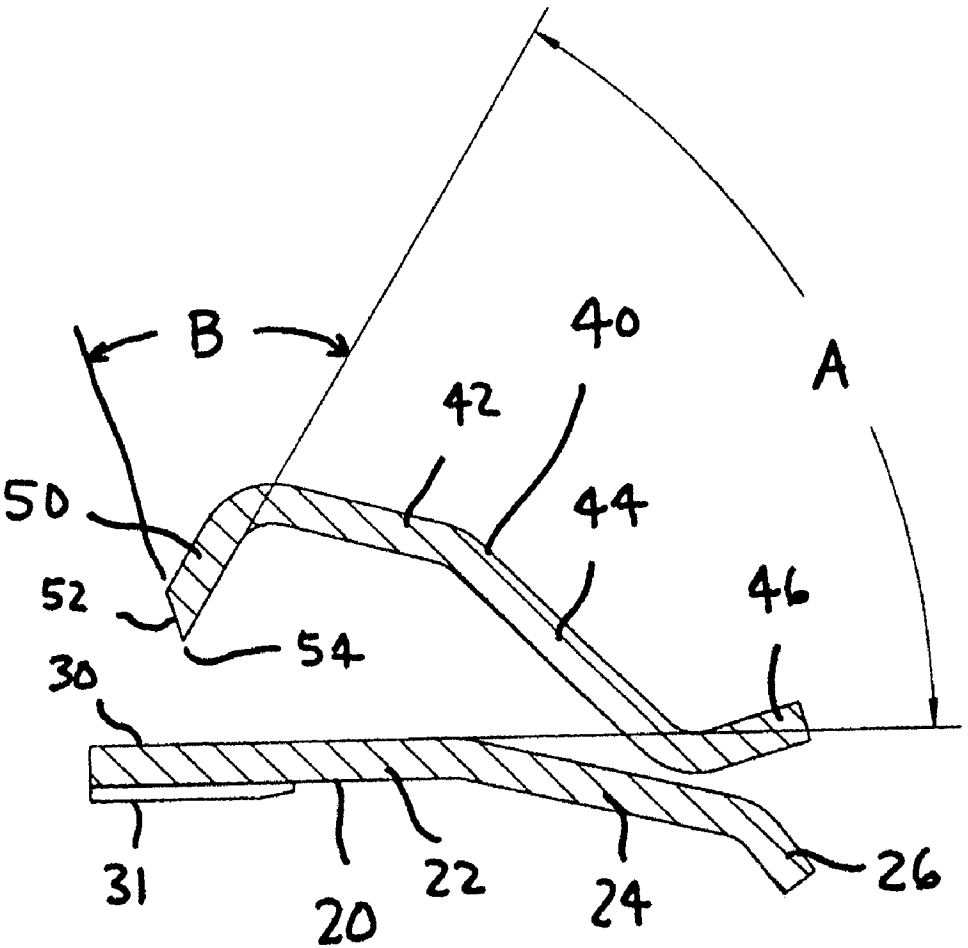
FIG. 8 is a cross section view of the contact device of FIG. 3 a showing the relative positions of the first blade portion and the second blade portion.

Referring to FIG. 8, the front angled blade portion 50 is oriented at an angle "A" relative to the first blade front contact surface 30 which angle is preferably between 50° and 65° and is preferably 63°. The cutting edge 52 is preferably formed at an angle "B" relative to the front angled blade portion 50 which angle is between 30° and 65° and is preferably 40°.

Figure 9:
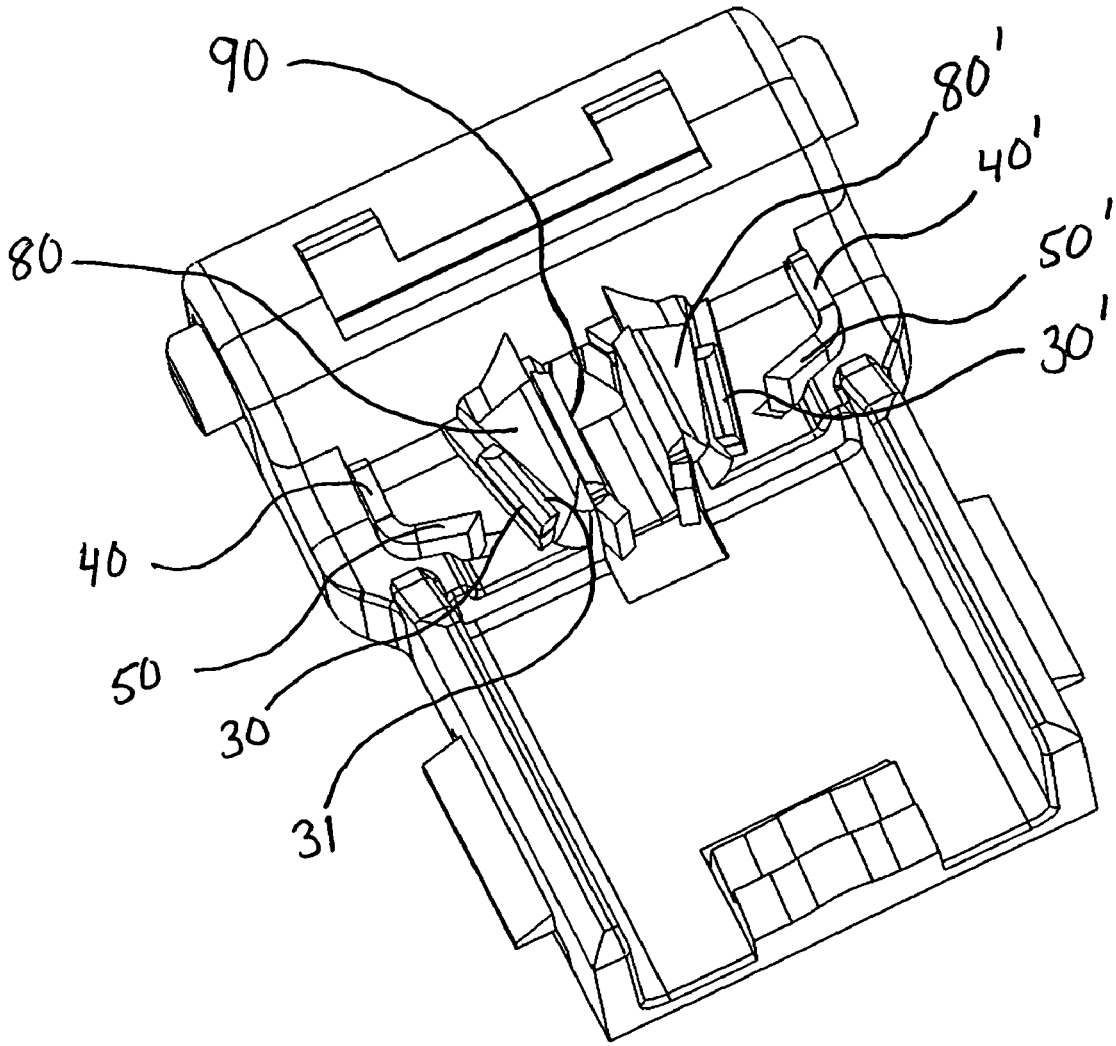
FIG. 9 is a perspective view of a lower surface of a lower portion of lid 16.

Referring to FIG. 9, which shows the lower surface of a lower portion of the lid 16, the orientation of angled blade portion 50 relative to the front contact surface 30 is shown. FIG. 9 also shows the shape location and orientation of an insulating end member 80 which is juxtaposed in tight contact with surface 31 which is opposite the surface 30 on the first blade contact surface portion. The insulated end member 80 is designed to cut into and remove at least a portion of the insulation from the solid wire conductor. The nature of the electrical cable 30 is shown in FIG. 7 which shows a neutral wire 100 a ground wire 120 and a hot wire 200. The neutral wire 100 has an insulated cover 106 thereon and hot wire 200 has an insulated cover 206 thereon. An outer sleeve 130 provides an additional cover over all of the wires 100, 120 and 200.

Figure 10:
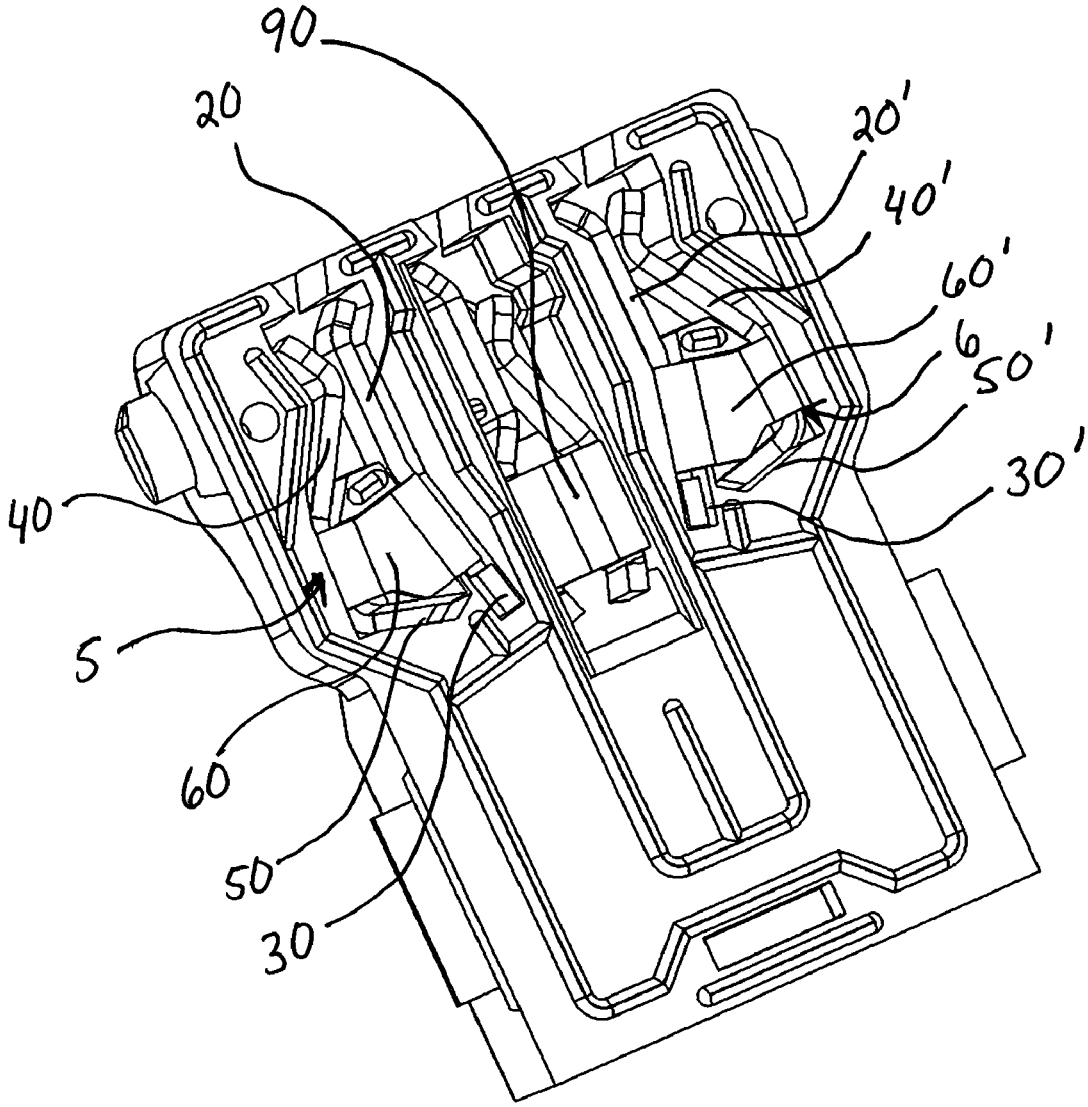
FIG. 10 is a perspective view of an upper surface of a lower portion of lid 16.

Referring to FIG. 10 the upper surface of a lower portion of the lid 16 is shown. This figure shows the relative location of contact devices 5 and 6 within the lid 16. FIG. 10 also shows the provision of a contact device 90 which is not the subject of the present application which is utilized to make electrical connection with a solid ground wire 120 which does not have a separate installation layer thereon.

This new device is uniquely shaped and, when manufactured in Applicant's Q-CEB connector, will allow the electrical contractor or end user to simply insert NM-B cable into the connector and in one easy movement close the connector and terminate the electrical conductors without manually stripping the sheathed cable or the insulated conductors. The connector will then perform the function of joining or coupling two cables together and also to be used as a connection means into wiring devices such as receptacles and switches.

It is to be understood that while certain forms of the present invention have been illustrated and described herein, the present invention is not to be limited to the specific forms or arrangements of parts described and shown.

I claim:

1. A contact device for insulated solid conductors of an insulation displacement connector of the type utilized to make electrical connections with an unstripped end of a multi-conductor cable having an outer sheath enclosing a ground wire and at least two insulated solid wire conductors comprising:

(a) a first blade portion having a front contact portion, a first blade middle portion and a first blade rear receiving end, said front contact portion being oriented generally parallel with a solid wire conductor;

(b) a second blade portion having a front angled blade portion, a second blade middle portion and a second blade rear receiving end, said front angled blade portion being not oriented parallel to said solid wire conductor; and (c) a bridge portion connecting said first blade portion to said second blade portion and securing said second blade portion in a spaced apart relationship with said first blade portion whereby, when said contact device is pushed into a multi-conductor cable, said front contact portion is in electrical contact with a first side of a solid wire conductor and said front angled blade portion is in electrical contact with a second side of said solid wire conductor;

wherein said solid wire conductor is disposed between said front contact portion and said front angled blade portion to form a reliable electrical connection.

2. A contact device according to claim 1 wherein, when said contact device is pushed into a multi-conductor cable, insulation is displaced on a first side of a solid wire conductor by said front contact portion and insulation is displaced on a second side of a solid wire conductor by said front angled blade portion.

3. A contact device according to claim 1 wherein said first blade portion has a first blade tail portion and said second blade portion has a second blade tail portion with said first blade tail portion and said second blade tail portion oriented relative to each other at an angle "D" of approximately 30 degrees.

4. A contact device according to claim 1 wherein said first blade rear receiving end and said second blade rear receiving end contact one another and diverge outwardly from each other at an angle "C" which is between 75 degrees and 90 degrees.

5. A contact device according to claim 1 wherein said first blade portion, said second blade portion and said bridge portion are formed of a copper alloy.

6. A contact device according to claim 1 wherein said front contact portion and said angled blade portion maintain a gas tight connection to said solid wire conductor even during variable conditions.

7. A contact device according to claim 1 wherein said variable conditions further comprise at least one of the following: expansion of the solid wire conductor, contraction of the solid wire conductor, movement of the solid wire conductor, expansion of the contact device, contraction of the contact device, and movement of the contact device.

8. A contact device according to claim 1 further comprising a pair of contact devices mounted in an insulation displacement connector with a first contact device of said pair adapted to make an electrical connection with one solid wire conductor to connect to a hot wire and a second contact device of said pair, said second contact device having a mirror image of said first contact device, adapted to make an electrical connection with a second solid wire conductor to connect to a neutral wire.

9. A contact device according to claim 1 wherein said bridge portion connects said first blade middle portion to said second blade middle portion.

10. A contact device according to claim 9 wherein said bridge portion connects said first blade middle portion to said second blade middle portion at an angle "E" which is between 0 degrees and 20 degrees.

11. A contact device for insulated solid conductors of an insulation displacement connector of the type utilized to make electrical connections with an unstripped end of a multi-conductor cable having an outer sheath enclosing a ground wire and at least two insulated solid wire conductors comprising:

(a) a first blade portion having a front contact portion, a first blade middle portion and a first blade rear receiving end;

(b) a second blade portion having a front angled blade portion, a second blade middle portion and a second blade rear receiving end; and (c) a bridge portion connecting said first blade portion to said second blade portion and securing said second blade portion in a spaced apart relationship with said first blade portion whereby, when said contact device is pushed into a multi-conductor cable, said front contact portion is in electrical contact with a first side of a solid wire conductor and said front angled blade portion is in electrical contact with a second side of said solid wire conductor wherein said front contact portion includes a generally flat contact area which is orientated generally parallel with said solid wire conductor whereby electrical contact is made along a length of said first side of a solid wire conductor thereby creating a large contact area.

12. A contact device for insulated solid conductors of an insulation displacement connector of the type utilized to make electrical connections with an unstripped end of a multi-conductor cable having an outer sheath enclosing a ground wire and at least two insulated solid wire conductors comprising:

(a) a first blade portion having a front contact portion, a first blade middle portion and a first blade rear receiving end;

(b) a second blade portion having a front angled blade portion, a second blade middle portion and a second blade rear receiving end; and (c) a bridge portion connecting said first blade portion to said second blade portion and securing said second blade portion in a spaced apart relationship with said first blade portion whereby, when said contact device is pushed into a multi-conductor cable, said front contact portion is in electrical contact with a first side of a solid wire conductor and said front angled blade portion is in electrical contact with a second side of said solid wire conductor wherein said front angled blade portion is formed at an angle "A" relative to said front contact portion whereby said front angled blade portion is not oriented parallel to said first side of a solid wire conductor and said front angled blade portion makes electrical contact with said solid wire conductor at a single point along a length of said conductor.

13. A contact device according to claim 12 wherein said angle "A" is between 50 degrees and 65 degrees.

14. A contact device according to claim 12 wherein said front angled blade portion has an angled cutting edge and a cutting point which cut into the second side of said solid wire conductor.

15. A contact device according to claim 14 wherein said angled cutting edge has an angle "B" which is between 30 degrees and 65 degrees.

16. A contact device for insulated solid conductors of an insulation displacement connector of the type utilized to make electrical connections with an unstripped end of a multi-conductor cable having an outer sheath enclosing a ground wire and at least two insulated solid wire conductors comprising:

(a) a first blade portion having a front contact portion, a first blade middle portion and a first blade rear receiving end;

(b) a second blade portion having a front angled blade portion, a second blade middle portion and a second blade rear receiving end; and (c) a bridge portion connecting said first blade portion to said second blade portion and securing said second blade portion in a spaced apart relationship with said first blade portion whereby, when said contact device is pushed into a multi-conductor cable, said front contact portion is in electrical contact with a first side of a solid wire conductor and said front angled blade portion is in electrical contact with a second side of said solid wire conductor, said contact device further comprising an insulating fin member juxtaposed tightly against an opposite surface of said front contact portion said insulating fin adapted to remove at least a portion of insulation from said solid wire conductor.

17. A contact device according to claim 16 wherein said first blade portion and said second blade portion will help remove any insulation on the solid wire conductor not removed by the insulating fin.

* * * * *